US006275449B1

(12) United States Patent
Wang

(10) Patent No.: US 6,275,449 B1
(45) Date of Patent: Aug. 14, 2001

(54) WORLD CLOCK WITH SYNCHRONOUS DISPLAY

(76) Inventor: Richard Wang, Fl. 1, No. 1, Lane 62, Low-Lee 2 Street, Anlow District, Keelong (TW)

( * ) Notice: Subject to any disclaimer, the term of this patent is extended or adjusted under 35 U.S.C. 154(b) by 0 days.

(21) Appl. No.: 09/130,375

(22) Filed: Aug. 7, 1998

(51) Int. Cl.[7] ..... G04B 19/22

(52) U.S. Cl. ..... 368/21; 368/25; 368/76; 368/223

(58) Field of Search ..... 368/21, 23, 25, 368/27, 82, 240, 76, 220, 223, 78, 226; D10/10; 434/146

(56) References Cited

U.S. PATENT DOCUMENTS

| | | | | |
|---|---|---|---|---|
| D. 312,788 | * | 12/1990 | Hirota | D10/10 |
| D. 312,971 | * | 12/1990 | Takashima | D10/10 |
| 434,137 | * | 8/1890 | Plechawski | 368/25 |
| 2,001,633 | * | 5/1935 | Segovia | 368/21 |
| 3,226,926 | * | 1/1966 | Kilburg | 368/21 |
| 3,232,038 | * | 2/1966 | Simth | 368/25 |
| 3,302,387 | * | 2/1967 | Wedde | 368/25 |
| 3,918,251 | * | 11/1975 | Wakabayashi | 368/25 |
| 4,102,121 | * | 7/1978 | Veazey | 368/21 |
| 4,308,604 | * | 12/1981 | Graham | 368/23 |
| 4,477,193 | * | 10/1984 | Yasufuku | 368/23 |
| 4,502,789 | * | 3/1985 | Heath | 368/21 |
| 4,579,460 | * | 4/1986 | Shannon | 368/23 |
| 4,779,247 | * | 10/1988 | Uchida | 368/223 |
| 5,007,033 | * | 4/1991 | Kubota et al. | 368/21 |
| 5,057,024 | * | 10/1991 | Sprott et al. | 434/146 |
| 5,146,436 | * | 9/1992 | Wright | 368/21 |
| 5,448,532 | * | 9/1995 | Kataoka et al. | 368/82 |
| 5,694,376 | * | 12/1997 | Sullivan | 368/82 |

* cited by examiner

*Primary Examiner*—Vit Miska
*Assistant Examiner*—Jeanne-Marguirite Goodwin
(74) *Attorney, Agent, or Firm*—Bacon & Thomas, PLLC

(57) ABSTRACT

A world clock includes a map with markings arranged to indicate time zones for actual geographic locations and a single-row table having 24 columns for correlating the markings with hour markings on a belt. The belt is driven by a controller to move one column every hour, with stoppage of the belt below the next column being controlled by a light sensor arranged to sense blank spaces on the belt between the hour markings.

6 Claims, 5 Drawing Sheets

09-24
Dark Blue
Purple
Red
Orange
Yellow
Yellow-Green
Green
Light-Blue
Gray
Light Gray Dark Blue
Purple
Red
Orange
Yellow
Yellow-Green
Green
Light-Blue
Gray
Light Gray

WORLD CLOCK WITH SYNCHRONOUS DISPLAY

BACKGROUND OF INVENTION

The inventor of this invention often travels around the world for international trade, and frequently troubled by time difference between countries or areas. At that time, the difficulties and complicate for finding the exact time are always discouraged people. Now for the better understanding, we make a comparison among the main exsisting types of world clocks.

I Circular display type such as disclosed in U.S. Pat. Nos. 4,579,460 and 5,146,346, the primary design is to print the world map of North or South Pole projection with respecting to the right time and the right cities.

The drawbacks comprise:

1. Spherical projection is not as easy as cylindric projection;

2. People are not accustomed to the radical arrangement for the main cities, if compare the horizontal or vertical arrangement;

3. The cost is high for its complicate structure.

II Data-Bank type such as disclosed in U.S. Pat. No. 5,448,532, whose main design is to built in a data bank of each respective regional time to the product for users to check by pushing button. Although this type is more compact and however, the operation process is repeated and complicate, and is not available f or displaying the exact time synchronously. In addition, the cities for reference are quite limited. Therefore, this type is not excellent, either.

III Type for reference between electronics and map such as disclosed in U.S. Pat. No. 4,779,247, U.S. Pat. No. Des 312,788, and U.S. Pat. No. Des 312,971, whose design basically is a combination of data-bank and world concise map. Similarly, operations required, and unable to be displayed regional time synchronously, are the main drawbacks.

IV Globe type such as disclosed in U.S. Pat. No. 4,477,193 and U.S. Pat. No. 5057024, both patents are related to the application of globe. The former one is joined with electronic clock of displaying regional time; the latter is combined with personal computer. Consequently, they are complicate and high cost. However, they also can not display the exact regional time synchronously.

V Digital type such as disclosed in U.S. Pat. No. 3,918,251, this design concept is close to this invention. It move one box per hour carried by the closed belt and the machine power of digital clock, to display the hour of 24 regional time, and to show the minute by a 2-digital drum, and to set the minute display zero as the standard time for driving the belt. Because the said us patent does not provide drawings for reference, the detail invention is still unknown. However, since the belt is carried by the machine power of digital clock, and the extra load for carrying belt is not fully considered in original digital clock design, the punctual degree will be influenced, and results in stop moving lastly. During my research, I already found that even the driving of small belt also need a relative power and torque. This reveals that there are always certain difference between theory and practice.

From above discussion, we known that the existing world clocks are somewhat inconvenience for users. This is also the motive for me to create this invention.

BRIEF OF THIS INVENTION

The primary concept of the synchronous display world clock is to combine microprocessor, auto-control device and the color/grid texture display of all time zones together to create this new world clock.

In detail, the inventor utilizes the quartz oscilation element for timing. Each hour, the micro processor will produce a signal to start the DC micro-motor for rolling the close type mylor film belt which being printed with 00~23 twice, to move one grid forward repesenting one hour. One side of the said belt has display windows (FIG. 1) showing the 24 world standard time zones, and the 6 sub-time zones by referring to the GMT time table which located above the display windows. Therefore, we can easily have all the 30 time zones without any action or operation. The LCD display of this invention indicates the user's home town local time, and displaying minutes also represent the time of the other 24 standard time zones. The minute time of 6 sub-time zones require to be subtracted or added 30 minutes according to next forward or backward standard time zones.

The color grid/texture map display system of all time zone is the innovation of this inventor by diligently studying the practical distribution of the world time zones. In general concept, people realize that the world time zones distributes in respect of the longitude of GMT. Every 15 degrees of longitude move eastward, the local time will be plused one hour namely "GMT+1 GMT+2 . . . ", and every 15 degrees of longitude move westward, the local time will be minused one hour namely "GMT−1, GMT−2 . . . ". However, quite a few countries don't follow the above rules for their administration political boundary or other particular considerations. Therefore, there will cause very high error percentage, if we obtain every time zones by the preceding method. That is why the inventor divide the world time zones grid following the practical time distribution, and express time zones by different color grid and texture (FIG. 1) to get the world time zones distribution very easy to read and to know.

The film belt is indicated either with 4 textures or with 4 colors such as orange, yellow, green and navy blue represents respectively as morning (05 AM~08 AM), day time (09 AM~16 PM), dusk (17 PM~20 PM) and night time (21 PM~04 AM). Traditionally, people use 2 colors such as white and black or red and blue region to distinguish day and night for the practical situation.

DETAIL SPECIFICATION OF THIS INVENTION

FIG. 1 to FIG. 5 are the brief drawings of the desk-top type and the wall hanging type of this invention, where in because the structures of the travel type and the wall insert type are similar to those of the former two types, we will not describe repeatly. However, the latter two types should be included to the claims, too.

Figures 1, 2, 3:
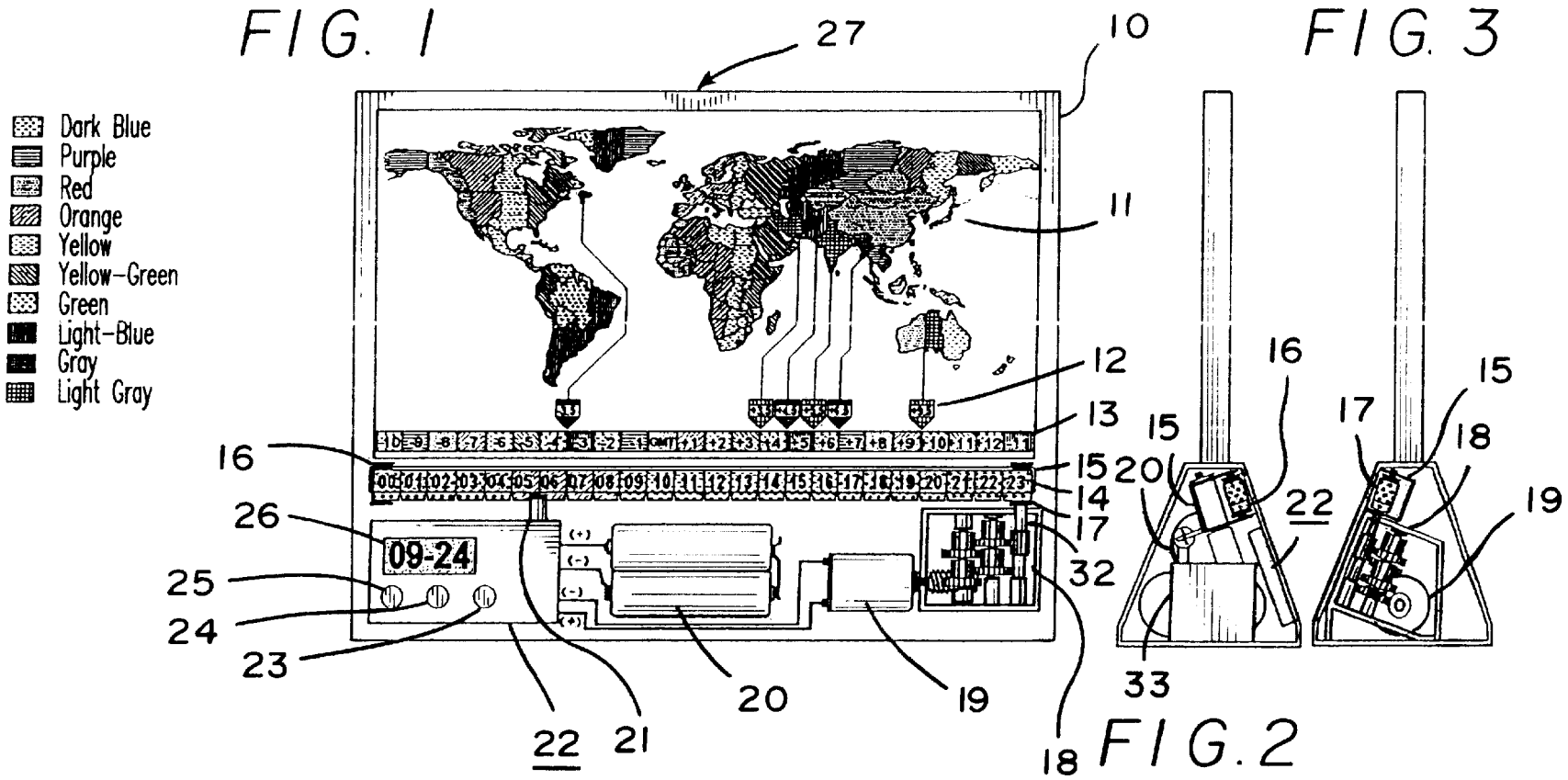
FIG. 1: Front view and perspective of the desk-top type of this invention.
FIG. 2: Left-side view and perspective of the desk-top type of this invention.
FIG. 3: Right-side view and perspestive of the desk-top type of this invention.
Figure 5:
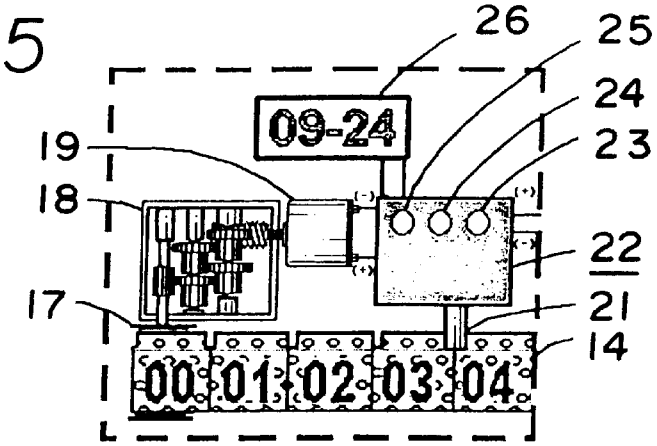
FIG. 5: Enlargement perspective of the part of main structure of the wall hanging type, this invention.
Figure 4:
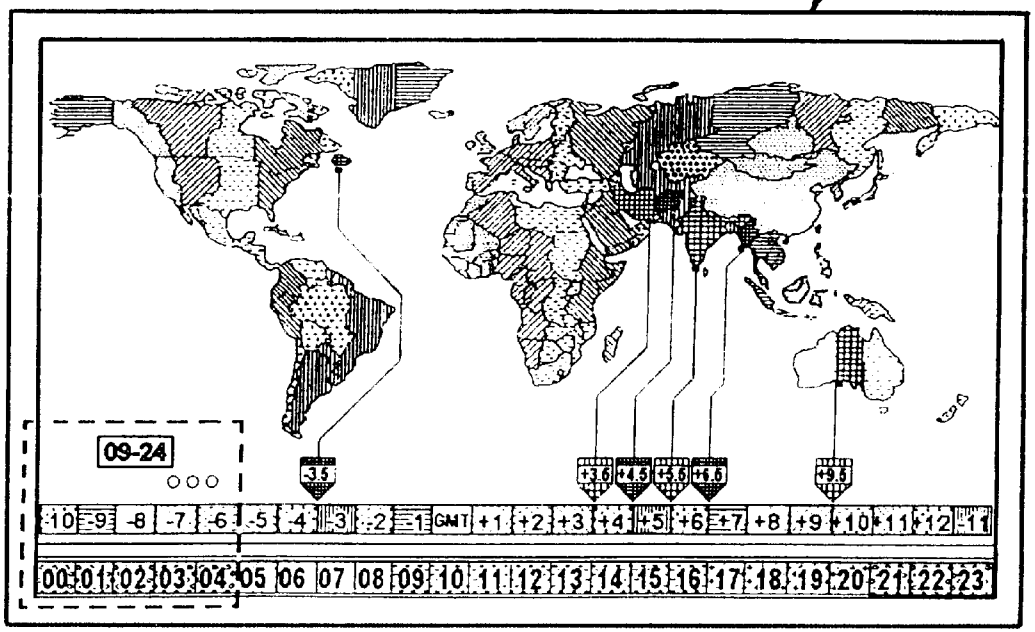
FIG. 4: Front view rendering of the wall hanging type of this invention.

Please refer to FIG. 1, it clearly disclosed that this desk-top type world clock of synchronous display 27 primarily comprise: a map frame 10 for supporting the world map 11 of all zone time grid/texture, 6 sub-zone time reference table 12, an index table 13 between GMT and all zone time color grid/texture map, a film belt 14 for displaying the time, an idle pulley 16 and a driven pulley 17 for supporting and fixing each ends of film belt 14, a speed decreasing gear set 18 and DC Motor 19.

This invention is printed with 00—23 twice (24×2=48) in 3 or more colors (FIG. 1) on a film belt 14, wherein 24 hours (48×0.5=24) face the display window, to seperately display the hour value of 24 standard zone time and 6 sub-zone time by referring the table 12, and the other 24 hours are hidden on the back of film belt 14.

Additionally, the film belt 14 owns 3 or more colors to match with the state of one day. In the embodiments, for instance, orange, yellow, green and navy blue seperately represents morning (05 AM–08 AM), day time (09 AM–16 PM), dusk(17 PM–20 PM) and night time (21 PM–04 AM). Moreover, it can use 3 or more different textures for division. In traditional way, 2 colors (such as white and black or red and blue) are usually used to divide day and night, and this is somewhat less practical and less scientific if compare to my invention, because the day time in 2 part division may be still in dark, and the night time may still see sun in the sky. Therefore, the quarter division of this invention is more easier to let user understand the related location between sun and each time zones. If refer to the latitude of the location, it is easy to know whether sunrise or sunset in the area.

Please refer to FIGS. 1, 2, and 3, the film belt 14 is fixed on the 2 ends of "C" type metal part, by rubber coated driven pulley 17 and idle pulley 16 having tension control design to ensure the required tension for belt's normal rotation and slide prevention. To observe from the display window, we find that the sequence of hours number on the film belt increases from west to east, and on the contrary, the film belt's forward direction is from east to west, which in consistent with the relative motion between sun and earth surface.

The film belt 14 rotates one grid per hour, which is carried by the rubber coated roller rotated with a forcing shaft, and the shaft is transferred power from a DC motor 19 which being decreased speed by gear set 18. The stop and locate function are reached by reading the blank on the film belt with a sensor switch. Since the film belt 14 is transparent, the blank part on it is transparent too. The sensor switch is a light-sensitive control mode. Therefore, the motor and the film belt 14 will be stopped simultaneously while the transparent blank (totally 48 blanks) of film belt rotates to the sensor switch 21 and thereby be transpierced by the sensitive light for starting the signal. Because the rotation speed of micromotor is not high originally, and will be diminished again by the speed decreasing gear set 18, the driving and stopping the film belt 14 has been tested to be very stable, and to be with very small inertia motion. Therefore, the hour indicator of film belt 14 and the scale of GMT will be line up accurately, and thus be easy for reading clearly.

POWER SUPPLY

The voltage adopted in this invention is DC 4.5V for considering the maximum and minimum voltage limit of microprocessor 22, auto-control circuit board, and micro DC motor 19. Since the voltage modular is highly electricity consumption, a common voltage 4.5V for all components will reduce the electricity caused by the voltage molduar.

The microprocessor 22 and auto-control circuit board require very small amount of electricity, and the micro DC motor 19 drives 2 seconds each time per hour (3600 sec), that is said, there will be a static state for 3588 sec. in every 3600 sec. Therefore, we can primarily estimate that each battery set can continuously operate for more than 200 days.

The reason for using DC battery instead of alternating current (AC) is based on the neat out look, mobility, and prevention of reset on losing AC occasionally. That is said, once we set up this world clock, it only need to be corrected after 200 days. During this 200 days, it will not require any operation, and can show you the time in any place in the world.

MAP DISPLAY SYSTEM OF ALL TIME ZONES COLOR GRID/TEXTURE

Please refer to FIG. 1, which is the map display system of all time zones color grid/texture of this invention. This world map of all time zones color grid/texture 11 is drawn in accordance with the practical distribution of world time zones, and uses the combined color grid textures of 8 colors (red, orange, yellow, yellow-green, blue, green, blue-purple, purple) or more than 4 colors to indicate the range of 24 standard time zones, and take the 3 cold grays and the 3 warm grays colors to be distinguished with the above colors used on the grids and textures to express the range of 6 sub-time zones 12. No 11, 12 and 13 are the time zones index Which is used for reference with index 14 to read all the 30 time zones of the world.

MICROPROCESSOR & AUTO-CONTROL CIRCUIT BOARD

Figure 6:
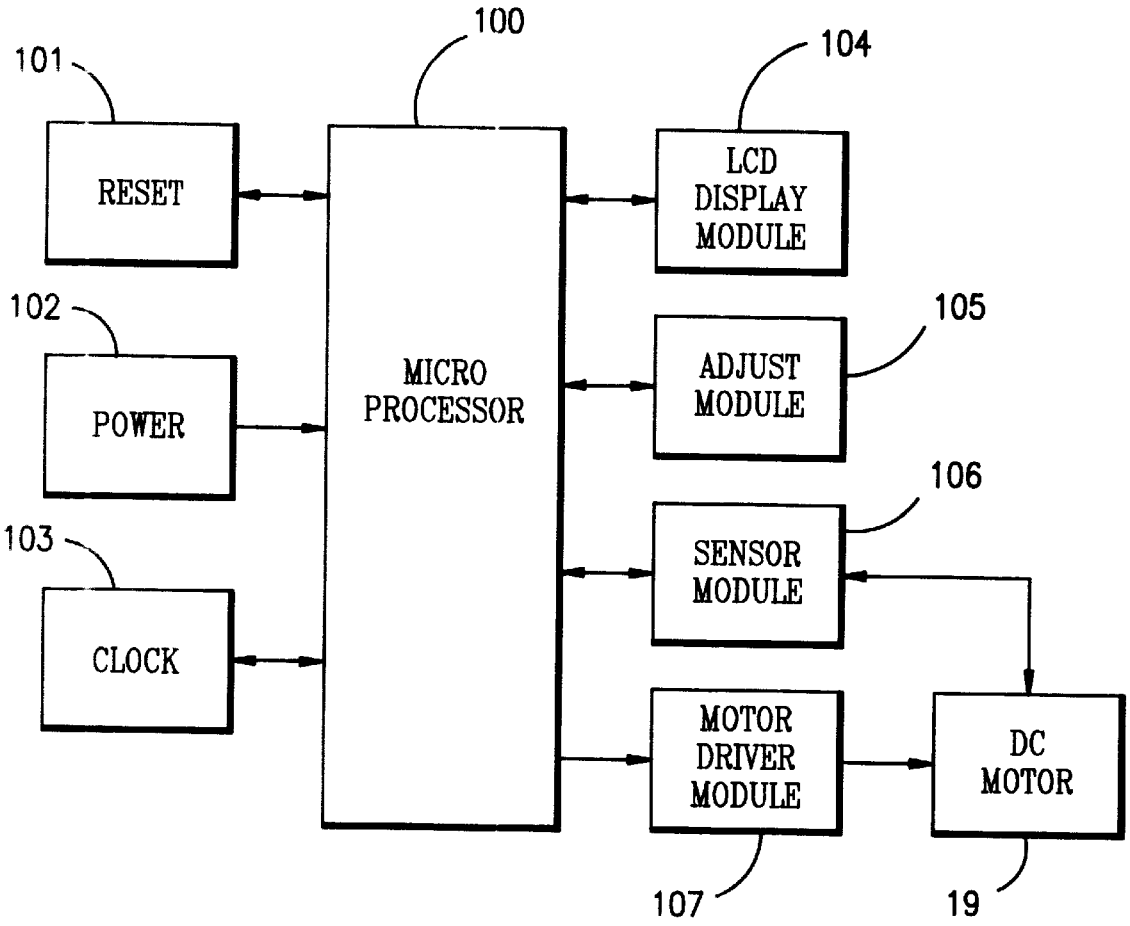
FIG. 6: Circuit layout of this invention.

The microprocessor and auto-control circuit board 22 of this invention is mainly consisted of components in FIG. 6. For cost down and electricity saving, the motor driving set 107 is not wired with traditional relay, and no element which cause higher electricity consumption.

LIQUID CRYSTAL DISPLAY

The liquid crystal display (LCD) 26 of this invention shows the home town local time, and the user can see the other area time through the map display system of all zone time color grid/texture.

There is no need for reseting or adjusting this world clock no matter how frequent or how many cities you stay. On the other way, you can know where you are by referring the color grid/texture map, if you know the exact local time.

DESCRIPTION on FIG.-6 CIRCUIT LAYOUT

The control circuit showed in the circuit layout of FIG. 6 is mainly consisted of microprocessor unit (MPU) and 8 function blocks. Following is the brief description of each components:

100 MICROPROCESSOR

101 RESET:

Setting for the disorder inside the MPU resulted from the abnormal operation environment (such as high voltage, current, magnetic interference)

102 POWER SUPPLY:

Being consisted of 3 1.5V batteries to supply DC 4.5V to both MPU and driving motor simultaneously.

103 CLOCK:

Being consisted of quartz oscillator and ceramic capacitor to produce stable and accurate pulse for MPU.

104 LCD DISPLAY MODULE:

To provide the readout between MPU and user, and display the local time while it is not in operational state.

105 ADJUST MODULE:

To provide the operation interface such as setting time and over drive action between MPU and user.

106 SENSOR MODULE:

The close type mylor film belt with 2 sets of 00~23 prints of synchronous display world clock, whose one step move forward indicater one hour passed, and its locating for stop function is reached by the location sensor of the light coupler which can detect the transparent blank on the film belt and feedback to MPU for grid movement and stop.

107 MOTOR DRIVE MODULE

To use the enlarge signal character of transistor to change the motor start/stop signal produced from MPU into an appropriate voltage/current driving motor in order to replace of the traditional type which starting motor with relay, in order to save the consumption of electricity.

19 DC MOTOR:

The power transmission device is increased torque through the connection of speed decreasing gear module, to rotate the film belt of time display smoothly.

DESCRIPTION OF SYSTEM FLOW CHART (FIG. 7)

Figure 7:
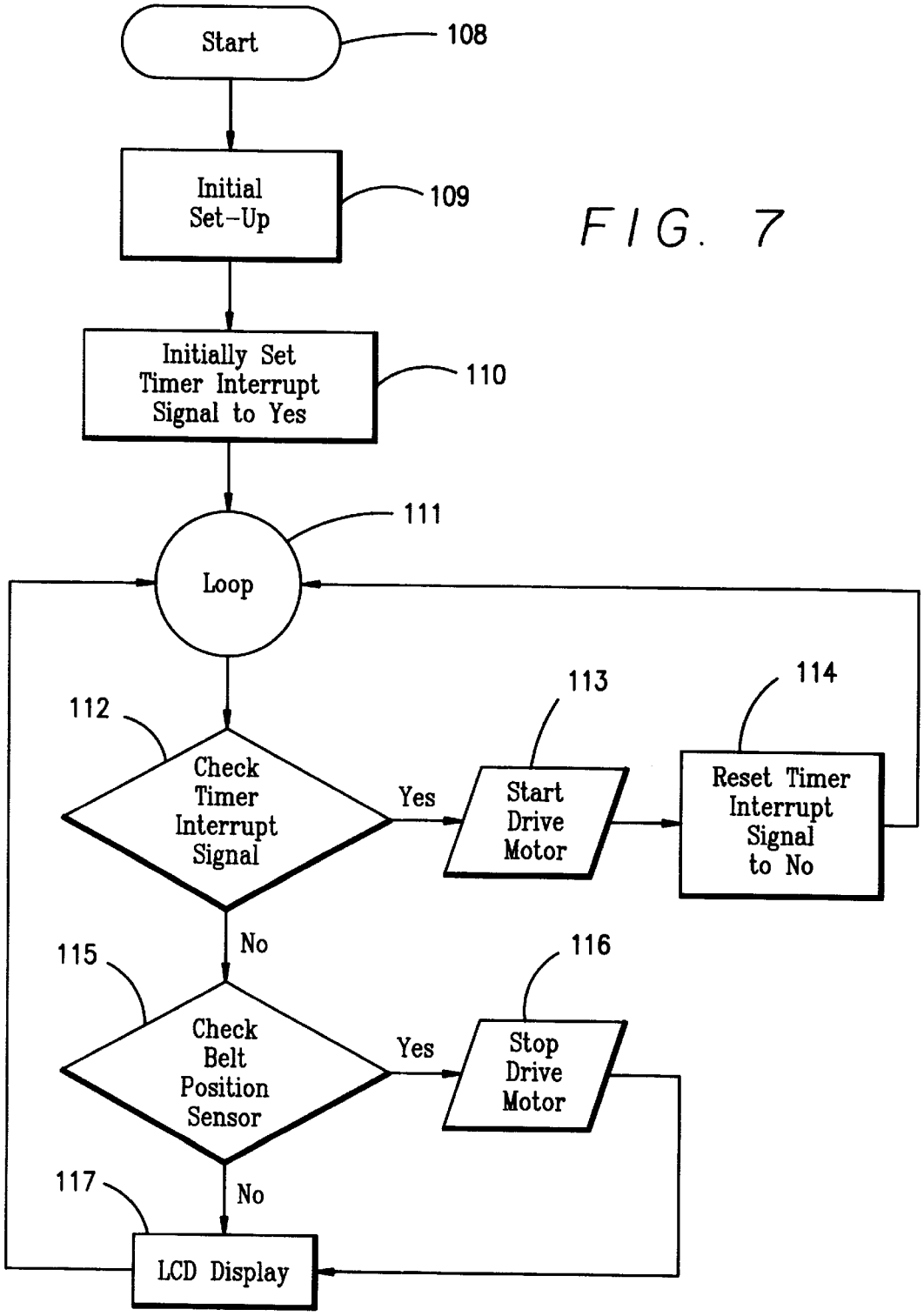
FIG. 7: System flow chart of this invention.

The control part of this synchronous display world clock employs the low cost microprocessor with functions of low electricity consumption and watch dog timer, where in the flow chart of control programs is as FIG. 7.

DESCRIPTION OF FIG. 108~117

108 START
109 SYSTEM INITIAL SETUP
110 SETUP TIMER INTERUPT
111 LOOP
112 CHECKOVER DRIVE (SWITCH#1)
113 DRIVE MOTOR
114 TIMER SET ON ZERO
115 CHECK S POSITION SENSOR (SWITCH#2)
116 STOP MOTOR
117 LCD DISPLAY

The design concept of whole program is to make the internal timer of MPU can cause interrupt per second by the pulse production of external part, and checks #112, over drive switch, and #115, position sensor, while in interruption, because the interruption's subroutine is responsible for the motor stating, whereas the stop of motor rotation requires the signal judgement feed backed from position sensor.

Figure 8:
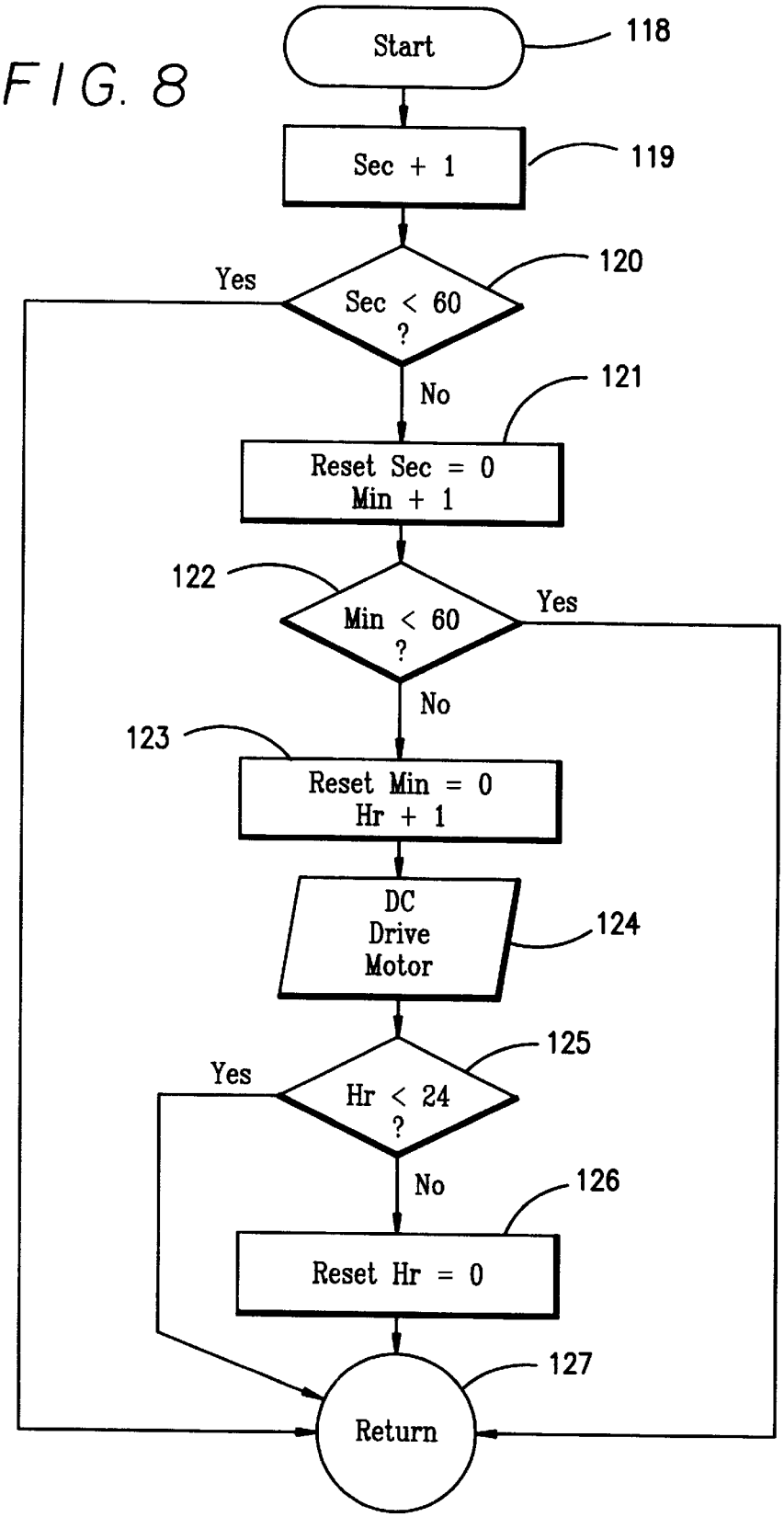
FIG. 8: System interrupt flow chart of this invention.

DESCRIPTION of SYSTEM INTERRUPT SUBROUTINE (FIG.-8)

118 INTERRUPT
119 SEC+1
120 SEC<60
121 RESET SEC=0, MIN+1
122 MIN<60
123 RESET MIN=0 HR+1
124 DC DRIVE MOTOR
125 HR<24
126 RESET HR=0
127 RETURN

To set the main program to produce one timer's interrupt per second, and then enter the interrupted subroutine, and calculate the times of interruption. Every 60 times equal to one minute, and every 60 times of one minute indicate one hour passed. At this moment, the motor will be activated immediately to carry the film belt of time display to rotate. The stop of motor is taken by the main program.

What is claimed is:

1. A world clock capable of synchronously displaying times in all world time zones, comprising:

a map having markings selected from the group consisting of markings, textures, and patterns, said markings being arranged to distinguish different time zones, said marking corresponding to an actual geographic arrangement of time zones on said map;

a reference indicator arranged as a table having one row and 24 regularly spaced columns, each column having one of said markings corresponding to one of said different time zones, whereby a position on the map may be correlated with a column in said table based on said markings;

a belt positioned adjacent said reference indicator, said belt having a set of 24 numbers on each side, the 24 numbers corresponding to 24 hours of day, such that one of said 24 numbers is positioned below each of said columns of said reference indicator;

a motor for driving said belt;

a controller arranged to cause said belt to move once every hour; and a position sensor arranged to send a position signal to said controller to cause the controller to stop movement of the belt so that each number moves to an adjacent column of said table once every hour, and remains stationary between said movements.

2. A world clock as claimed in claim 1, wherein said belt is connected to said motor via a pulley and a speed reducing gear set.

3. A world clock as claimed in claim 1, further comprising a set of sub-time zone indicators to indicate positions of six sub-time zones relative to said table.

4. A world clock as claimed in claim 1, wherein said belt further includes at least three colors corresponding to divisions of a day.

5. A world clock as claimed in claim 4, wherein said belt includes four additional colors to indicate nighttime, morning, daytime, and dusk.

6. A world clock as claimed in claim 1, wherein said belt is transparent and said position sensor senses blank spaces between said numbers.

* * * * *